US011746634B2

(12) United States Patent
Converse et al.

(10) Patent No.: US 11,746,634 B2
(45) Date of Patent: Sep. 5, 2023

(54) OPTIMIZING FUEL CONSUMPTION AND EMISSIONS OF A MULTI-RIG HYDRAULIC FRACTURING SYSTEM

(71) Applicant: Caterpillar Inc., Peoria, IL (US)

(72) Inventors: Perry D. Converse, Lafayette, IN (US); Casey Alan Otten, Spring, TX (US); Joseph C. Bufkin, Spring, TX (US); Zhijun Cai, Dunlap, IL (US); Baoyang Deng, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/577,886

(22) Filed: Jan. 18, 2022

(65) Prior Publication Data

US 2023/0228178 A1 Jul. 20, 2023

(51) Int. Cl.
*E21B 43/26* (2006.01)
*F04B 17/03* (2006.01)
(Continued)

(52) U.S. Cl.
CPC ..... *E21B 43/2607* (2020.05); *E21B 43/26* (2013.01); *F04B 17/03* (2013.01);
(Continued)

(58) Field of Classification Search
CPC .... E21B 43/2607; E21B 43/26; E21B 43/267; F04B 17/03; F04B 17/05; F04B 17/06; F04B 49/007; F04B 49/065; F04B 49/20
See application file for complete search history.

(56) References Cited

U.S. PATENT DOCUMENTS 8,205,594 B2 6/2012 Fore et al.
9,255,531 B2 2/2016 Zhang et al.
(Continued)

FOREIGN PATENT DOCUMENTS

DE 102014017500 A1 6/2016
DE 202017105323 U1 9/2017
WO WO-2014029000 A1 * 2/2014 ..... E21B 43/26

OTHER PUBLICATIONS

Unpublished U.S. Appl. No. 17/110,415, filed Dec. 3, 2020.

*Primary Examiner* — James G Sayre

(57) ABSTRACT

A method may include receiving power supply-related information, cost-related information, power demand-related information, and operational priority or site configuration-related information associated with hydraulic fracturing rigs. The hydraulic fracturing rigs may be each associated with a fuel consumption component or an emissions component. The method may further include receiving operational data and determining operational parameters based on the operational data and emissions output predictions for the hydraulic fracturing rigs. The method may further include outputting the operational parameters to a computing device or a controller. The method may further include, based on outputting the operational parameters, receiving operational feedback data and determining whether to modify the operational parameters. In addition, based on the outputting, the method may include determining whether to modify the operational data based on determining to not modify the set of operational parameters and modifying the operational data based on determining to modify the operational data.

20 Claims, 4 Drawing Sheets

(51) Int. Cl.

| | |
|---|---|
| ***F04B 17/05*** | (2006.01) |
| ***F04B 49/20*** | (2006.01) |
| ***F04B 49/06*** | (2006.01) |
| ***F04B 49/00*** | (2006.01) |
| ***F04B 17/06*** | (2006.01) |
| ***E21B 43/267*** | (2006.01) |

(52) U.S. Cl.
CPC ..... *F04B 17/05* (2013.01); *F04B 17/06* (2013.01); *F04B 49/007* (2013.01); *F04B 49/065* (2013.01); *F04B 49/20* (2013.01); *E21B 43/267* (2013.01)

(56) References Cited

U.S. PATENT DOCUMENTS

| | | | | |
|---|---|---|---|---|
| 9,683,503 | B2 | 6/2017 | Zhang et al. | |
| 9,889,915 | B2 | 2/2018 | Zhang et al. | |
| 9,890,677 | B2 * | 2/2018 | Adams | G05B 23/0294 |
| 9,896,982 | B1 | 2/2018 | Zhang et al. | |
| 10,344,687 | B2 | 7/2019 | Gallagher et al. | |
| 10,415,348 | B2 | 9/2019 | Zhang et al. | |
| 10,458,352 | B2 | 10/2019 | Zhang et al. | |
| 10,563,649 | B2 | 2/2020 | Zhang et al. | |
| 10,597,996 | B2 * | 3/2020 | Boone | H02J 3/38 |
| 10,734,814 | B2 | 8/2020 | Converse et al. | |
| 10,760,996 | B2 | 9/2020 | Converse et al. | |
| 10,890,061 | B2 | 1/2021 | Cai et al. | |
| 10,927,774 | B2 | 2/2021 | Cai et al. | |
| 10,934,949 | B2 | 3/2021 | Rutledge | |
| 11,408,417 | B1 * | 8/2022 | Stephenson | E21B 43/2607 |
| 11,473,413 | B2 * | 10/2022 | Yeung | F04B 23/04 |
| 2006/0088423 | A1 * | 4/2006 | Brunet | F04B 49/065 417/42 |
| 2012/0085541 | A1 * | 4/2012 | Love | G06Q 30/02 166/308.1 |
| 2016/0222771 | A1 * | 8/2016 | Stephenson | E21B 43/26 |
| 2017/0012439 | A1 | 1/2017 | Zhang et al. | |
| 2017/0130712 | A1 | 5/2017 | Zhang et al. | |
| 2018/0266241 | A1 * | 9/2018 | Ferguson | E21B 43/26 |
| 2021/0372256 | A1 * | 12/2021 | Yeung | E21B 43/2607 |

* cited by examiner

OPTIMIZING FUEL CONSUMPTION AND EMISSIONS OF A MULTI-RIG HYDRAULIC FRACTURING SYSTEM

TECHNICAL FIELD

The present disclosure relates generally to a hydraulic fracturing system including multiple hydraulic fracturing rigs, and more particularly, to optimizing fuel consumption and emissions of a multi-rig hydraulic fracturing system.

BACKGROUND

Hydraulic fracturing is a means for extracting oil and gas from rock, typically to supplement a horizontal drilling operation. In particular, high pressure fluid is used to fracture the rock, stimulating the flow of oil and gas through the rock to increase the volumes of oil or gas that can be recovered. A hydraulic fracturing rig used to inject high pressure fluid, or fracturing fluid, includes, among other components, an engine, transmission, driveshaft, and pump.

Hydraulic fracturing may involve the use of a hydraulic fracturing system that includes multiple hydraulic fracturing rigs operating at the same or different pressures to achieve a flow rate for the fluid (e.g., measured in barrels per minute). However, operation of the hydraulic fracturing rigs does not take into account other considerations, such as the total emissions produced by the hydraulic fracturing rigs or fuel consumption cost of the hydraulic fracturing rigs. For example, these rigs exhaust a complex mixture of air pollutants that are generally composed of particulates and gaseous compounds including nitrogen oxides (commonly referred to as "NOx") and carbon dioxides (commonly referred to as "$CO_2$") or carbon dioxide equivalents ($CO_2e$), among others. Due to increased awareness of the environment, exhaust emission standards have become more stringent, and the amounts of particulates and gasses emitted into the atmosphere by a hydraulic fracturing rig may be regulated depending on, for example, the location in which the hydraulic fracturing rig is operating or the type of fuel used to power the hydraulic fracturing rig. Furthermore, emissions from a hydraulic fracturing rig may have associated costs imposed by regulatory organizations based on the amount of emissions from the hydraulic fracturing rig. In addition to emissions, fuel consumption may have variable costs depending on location of the hydraulic fracturing rig, efficiency of the hydraulic fracturing rig, and the like.

German Patent Publication No. DE102014017500A1, published on Jun. 2, 2016 ("the '500 reference") describes that, while providing required power, an individual operating point is determined for each running internal combustion engine in such a way that the system incurs minimal operating costs while complying with emission limit values. However, the '500 reference does not optimize emissions or other operating-related parameters, such as fuel consumption, of a hydraulic fracturing rig based on operational data related to the performance characteristics of the hydraulic fracturing rig, which may include efficiency maps for a combustion component, an emissions component, or an emissions reduction system of the hydraulic fracturing rig.

The present disclosure may solve one or more of the problems set forth above and/or other problems in the art. The scope of the current disclosure, however, is defined by the attached claims, and not by the ability to solve any specific problem.

SUMMARY

In one aspect, a hydraulic fracturing system may include a plurality of hydraulic fracturing rigs at a site where each of the plurality of hydraulic fracturing rigs may include one or more fuel consumption components and one or more emissions components. The hydraulic fracturing system may further include one or more controllers configured to control operation of the plurality of hydraulic fracturing rigs and a site controller in communication with the plurality of hydraulic fracturing rigs and the one or more controllers. The site controller may be configured to receive power supply-related information, cost-related information, power demand-related information, and operational priority or site configuration-related information associated with the plurality of hydraulic fracturing rigs. The site controller may be further configured to receive operational data associated with the one or more fuel consumption components or the one or more emissions components and determine a set of operational parameters based on the operational data and emissions output predictions for the plurality of hydraulic fracturing rigs. The site controller may be further configured to determine emissions savings of the plurality of hydraulic fracturing rigs based on the set of operational parameters and output, to one or more computing devices or the one or more controllers, the set of operational parameters or the emissions savings.

The operational data may include one or more emissions maps, one or more performance maps, or one or more fuel maps. The cost-related information may include one or more costs of one or more fuels, a total cost of ownership of the plurality of hydraulic fracturing rigs, or one or more costs of the emissions of the plurality of hydraulic fracturing rigs. The site controller may be further configured to receive operational feedback data from the one or more controllers after outputting the set of operational parameters to the one or more controllers.

The site controller may be further configured to determine whether to modify the set of operational parameters based on the operational feedback data. The site controller may be further configured to re-determine the set of operational parameters based on determining to modify the set of operational parameters, or determine whether to modify the operational data based on determining to not modify the set of operational parameters. The site controller may be further configured to verify modifications to the operational data based on determining to modify the operational data and update the operational data after verifying the operational data.

In another aspect, a method may include receiving power supply-related information, cost-related information, power demand-related information, and operational priority or site configuration-related information associated with a plurality of hydraulic fracturing rigs. The plurality of hydraulic fracturing rigs may be each associated with one or more fuel consumption components or one or more emissions components. The method may further include receiving operational data associated with the one or more fuel consumption components or the one or more emissions components and determining a set of operational parameters based on the operational data and emissions output predictions for the plurality of hydraulic fracturing rigs. The method may further include outputting the set of operational parameters to one or more computing devices or one or more controllers.

The method may further include, based on outputting the set of operational parameters to the one or more controllers, receiving operational feedback data from the one or more controllers and determining whether to modify the set of operational parameters based on the operational feedback data received from the one or more controllers. In addition, based on the outputting, the method may include determining whether to modify the operational data based on determining to not modify the set of operational parameters and modifying the operational data based on determining to modify the operational data.

The one or more fuel consumption components or the one or more emissions components may include one or more variable frequency drives (VFD), one or more motors, or one or more pumps. The method may further include re-receiving the power supply-related information, the cost-related information, the power demand-related information, and the operational priority or site configuration-related information after modifying the operational data. The modifying of the operational data may further include verifying modifications to the operational data based on determining to modify the operational data and updating the operational data after verifying the operational data.

The power supply-related information may include a desired engine operating range for the plurality of hydraulic fracturing rigs, an engine online/offline status for the plurality of hydraulic fracturing rigs, or a desired power reserve for the plurality of hydraulic fracturing rigs. The power demand-related information may include a power demand for an experienced or expected load on engines of the plurality of hydraulic fracturing rigs. The operational priority or site configuration-related information may include an engine priority between the plurality of hydraulic fracturing rigs, an operating mode of the plurality of hydraulic fracturing rigs, a quantity of hydraulic fracturing rigs included in the plurality of hydraulic fracturing rigs, or a flow rate of the plurality of hydraulic fracturing rigs.

In yet another aspect, a site controller may be associated with a plurality of power sources for driving a load. The plurality of power sources may each include one or more fuel consumption components and one or more emissions components. The site controller may be configured to receive power supply-related information, cost-related information, power demand-related information, and operational priority or site configuration-related information associated with the plurality of power sources. The site controller may be further configured to receive operational data associated with the one or more fuel consumption components or the one or more emissions components and determine a set of operational parameters based on the operational data or emissions output predictions for the plurality of power sources. The site controller may be further configured to output the set of operational parameters to one or more computing devices or one or more controllers.

The plurality of power sources may include one or more mechanical hydraulic fracturing rigs or one or more electric hydraulic fracturing rigs and the one or more mechanical hydraulic fracturing rigs or the one or more electric hydraulic fracturing rigs may provide flow, proppant demand, and pressure response associated with an experienced or expected load on an engine. The site controller may be further configured to receive operational feedback data from the one or more controllers after outputting the set of operational parameters to the one or more controllers. The site controller may be further configured to determine whether to modify the set of operational parameters based on the operational feedback data.

The site controller may be further configured to re-determine the set of operational parameters based on determining to modify the set of operational parameters, or determine whether to modify the operational data based on determining not to modify the set of operational parameters. The site controller may be further configured to modify the operational data based on determining to modify the operational data and re-receive the power supply-related information, the cost-related information, the power demand-related information, and the operational priority or site configuration-related information based on modifying the operational data.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
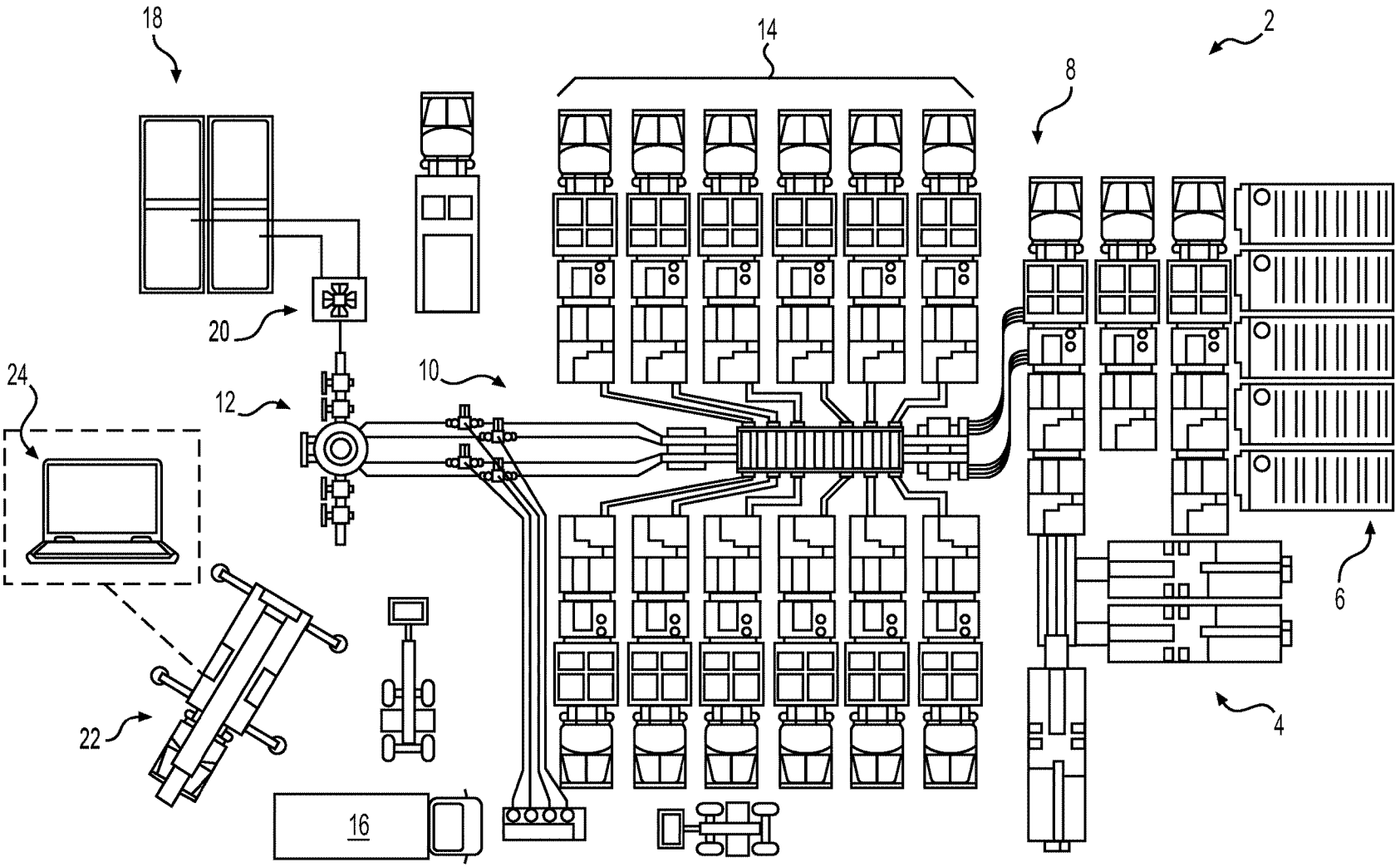
FIG. 1 is a schematic diagram of an exemplary hydraulic fracturing system including a plurality of hydraulic fracturing rigs, according to aspects of the disclosure.

FIG. 1 illustrates an exemplary hydraulic fracturing system 2 according to aspects of the disclosure. In particular, FIG. 1 depicts an exemplary site layout according to a well stimulation stage (i.e., hydraulic fracturing stage) of a drilling/mining process, such as after a well has been drilled at the site and the equipment used for drilling removed. The hydraulic fracturing system 2 may include fluid storage tanks 4, sand storage tanks 6, and blending equipment 8 for preparing a fracturing fluid. The fracturing fluid, which may, for example, include water, sand, and one or more chemicals, may be injected at high pressure through one or more fluid lines 10 to a well head 12 using a plurality of hydraulic fracturing rigs 14.

A trailer-mounted bleed off tank 16 may be provided to receive bleed off liquid or gas from the fluid lines 10. In addition, nitrogen, which may be beneficial to the hydraulic fracturing process for a variety of reasons, may be stored in tanks 18, with a pumping system 20 used to supply the nitrogen from the tanks 18 to the fluid lines 10 or well head 12.

The hydraulic fracturing process performed at the site, using the hydraulic fracturing system 2 of the present disclosure, and the equipment used in the process, may be managed and/or monitored from a single location, such as a data monitoring system 22, located at the site or at additional or alternative locations. According to an example, the data monitoring system 22 may be supported on a van, truck or may be otherwise mobile. As will be described below, the data monitoring system 22 may include a user device 24 for displaying or inputting data for monitoring performance and/or optimizing operation of the hydraulic fracturing system 2 and/or the hydraulic fracturing rigs 14. According to one embodiment, the data gathered by the data monitoring system 22 may be sent off-board or off-site for monitoring performance and/or performing calculations relative to the hydraulic fracturing system 2.

Figure 2:
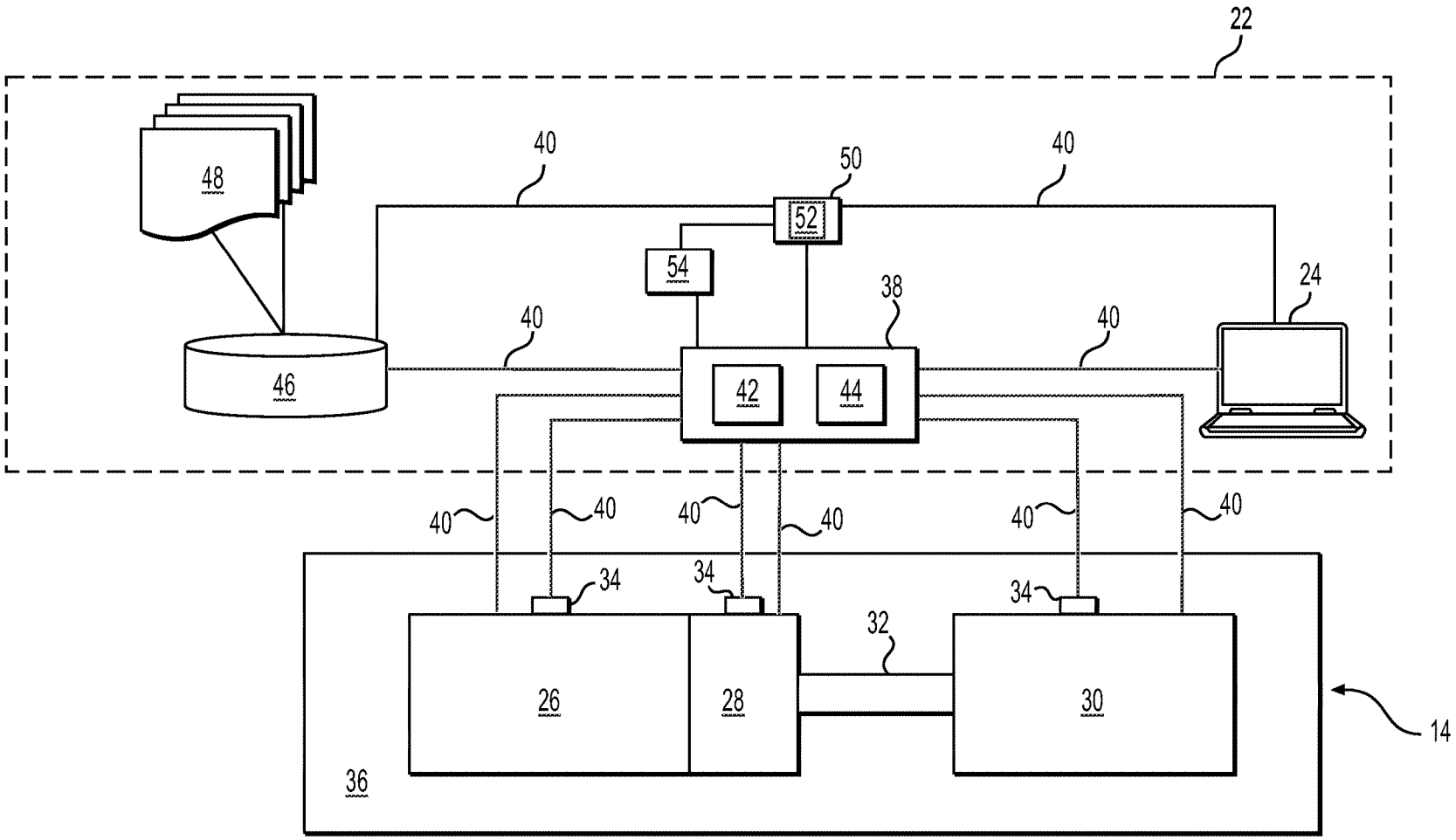
FIG. 2 is a schematic diagram of a hydraulic fracturing rig and associated systems of the hydraulic fracturing system of FIG. 1, according to aspects of the disclosure.

Referring to FIG. 2, the plurality of hydraulic fracturing rigs 14 may each generally include an engine 26 or other source of power (e.g., a turbine or an electric motor with a variable frequency drive (VFD) in the case of an electric hydraulic fracturing rig 14), a transmission 28, and a hydraulic fracturing pump 30. A driveshaft 32 may be coupled between the transmission 28 and the hydraulic fracturing pump 30 for transferring torque from the engine 26 to the hydraulic fracturing pump 30. One or more components of the hydraulic fracturing rig 14 may be, or may include, a fuel consumption component that is configured to consume fuel (e.g., diesel, natural gas, hydrogen, or synthesis gas) during operation of the hydraulic fracturing rig 14, and the engine 26 may be one example of a fuel consumption component. Additionally, or alternatively, one or more components of the hydraulic fracturing rig 14 may be, or may include, an emissions component that outputs emissions during operation of the hydraulic fracturing rig 14, and an exhaust of the engine 26 may be one example of an emissions component.

A hydraulic fracturing rig 14 may further include one or more systems configured to control or reduce emissions from the fuel consumption component or the emissions component. For example, the hydraulic fracturing rig 14 may include a selective catalytic reduction (SCR) system configured to implement a process where a reagent known as diesel exhaust fluid (DEF), such as urea or a water/urea solution, is selectively injected into the exhaust gas stream of the engine 26 and absorbed onto a downstream substrate in order to reduce the amount of nitrogen oxides in the exhaust gases. As another example, the hydraulic fracturing rig 14 may include an exhaust gas recirculation (EGR) system configured to recirculate a portion of the exhaust gasses from the engine 26 back into an air induction system for subsequent combustion. As yet another example, the hydraulic fracturing rig 14 may include a lean burn system configured to burn, or attempt to burn, gaseous fuel and air at a stoichiometrically lean equivalence ratio.

One or more sensors 34 may be positioned and configured to detect or measure one or more physical properties related to operation and/or performance of the various components of the hydraulic fracturing rig 14. For example, a sensor 34 may provide a sensor signal indicative of the fracturing fluid inlet or outlet pressure at pump 30, a sensor signal indicative of a rotational speed of an engine 26, a sensor signal indicative of a gear position of the transmission 28, a sensor signal indicative of an amount of fuel consumed by the engine 26, a sensor signal indicative of an amount of certain gasses or particulates in emissions from the engine 26, a temperature of the engine 26, and/or the like. The hydraulic fracturing rig 14 may be mobile, such as supported on a tractor-trailer 36, so that it may be more easily transported from site to site. Each of the hydraulic fracturing rigs 14 included in the hydraulic fracturing system 2 may or may not have similar configurations.

At least one controller 38 may be provided, and may be part of, or may communicate with, the data monitoring system 22. The controller 38 may reside in whole or in part at the data monitoring system 22, or elsewhere relative to the hydraulic fracturing system 2. Further, the controller 38 may be configured to communicate with the sensors 34 and/or various other systems or devices via wired and/or wireless communication lines 40, using available communication schemes, to monitor and control various aspects of each hydraulic fracturing rig 14 and/or each respective engine 26, transmission 28, and/or hydraulic fracturing pump 30. There may be one or more controllers 38 positioned at or supported on each component of the hydraulic fracturing rig 14, and one or more controllers 38 configured for coordinating control of the component-level controllers 38 and/or the overall hydraulic fracturing system 2.

The controller 38 may include a processor 42 and a memory 44. The processor 42 may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor 42 may possess its own local memory 44, which also may store program modules, program data, and/or one or more operating systems. The processor 42 may include one or more cores.

The memory 44 may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., the user device 24, a server device, etc.). The memory 44 may be implemented as computer-readable storage media (CRSM), which may be any available physical media accessible by the processor 42 to execute instructions stored on the memory 44. The memory 44 may have an operating system (OS) and/or a variety of suitable applications stored thereon. The OS, when executed by the processor 42, may enable management of hardware and/or software resources of the controller 38.

The memory 44 may be capable of storing various computer readable instructions for performing certain operations described herein (e.g., operations of a site controller 50 and/or the controller 38). The instructions, when executed by the processor 42, may cause certain operations described herein to be performed.

In addition to the controller 38, the data monitoring system 22 may include, or may be in communication with, the site controller 50. Similar to the controller 38, the site controller 50 may reside in whole or in part at the data monitoring system 22, or elsewhere relative to the hydraulic fracturing system 2. Although the controller 38 and the site controller 50 may include similar components, the controller 38 may be associated with controlling a particular piece of equipment (or component thereof), such as a hydraulic fracturing rig 14, whereas the site controller 50 may control and/or coordinate operations of multiple pieces of equipment, such as multiple hydraulic fracturing rigs 14 or a combination of a hydraulic fracturing rig 14 and the blending equipment 8 at a site or across multiple sites.

Although not illustrated in FIG. 2, the site controller 50 may also include a processor 42 and a memory 44. The site controller 50 may be configured to communicate with the controller 38 and/or various other systems or devices via wired and/or wireless communication lines 40 to monitor and/or control various aspects of the hydraulic fracturing rig 14 or components thereof, as described elsewhere herein. For instance, the site controller 50 may store and/or execute an optimization program 52 to optimize fuel costs and/or emissions costs of the hydraulic fracturing rig 14 and/or the hydraulic fracturing system 2 (e.g., based on data stored in the memory 44 of the site controller 50 or as otherwise provided to the site controller 50, such as via the user device 24 or from database 46 as data 48). Data used by the site controller 50 may include power supply operation-related information, cost-related information, power demand-related information, or operational priority and/or site configuration-related information, as described elsewhere herein. However, various other additional or alternative data may be used.

The data monitoring system 22 may further include a load manager 54. The load manager 54 may include a processor 42 and a memory 44 (not illustrated in FIG. 2) and may be configured to determine a power demand for the engine 26 based on, for example, operator input related to fracturing operations at a site.

Figure 3:
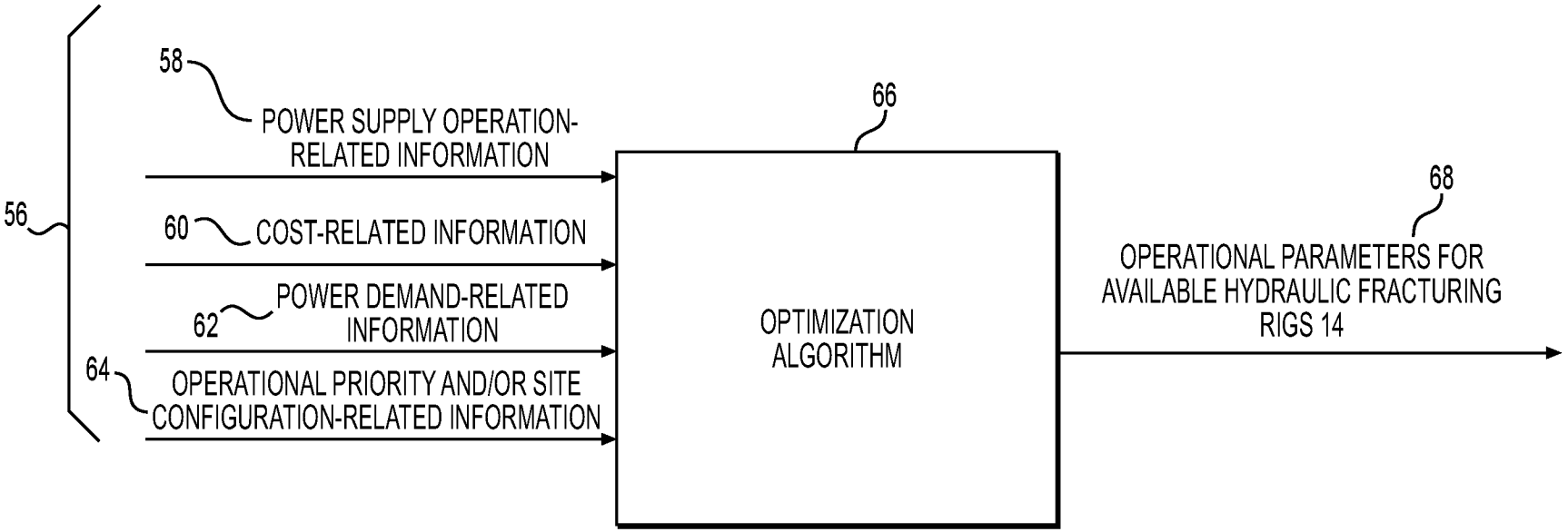
FIG. 3 is a diagram illustrating an exemplary optimization algorithm, according to aspects of the disclosure.

FIG. 3 is a diagram illustrating an exemplary optimization program 52, according to aspects of the disclosure. As illustrated in FIG. 3, the optimization program 52 may receive input data 56 and may provide the input data 56 to an optimization algorithm 66. For example, the optimization program 52 may receive the input data 56 from the user device 24 (e.g., a user may input the input data 56 via the user device 24), from a server device, from a database, from memory of various equipment or components thereof of the hydraulic fracturing system 2, and/or the like. The optimization program 52 may receive the input data 56 as a stream of data during operation of the hydraulic fracturing system 2, prior to starting operations of the hydraulic fracturing system 2, and/or the like. The input data 56 may be predetermined and provided to the optimization program 52 (e.g., may be based on experimental or factory measurements of equipment), may be generated by the site controller 50 (e.g., the site controller 50 may broadcast a ping communication at a site in order to receive response pings from equipment at the site to determine which equipment is present, the site controller 50 may measure, from sensor signals, the input data 56, etc.), and/or the like.

The input data 56 may include power supply operation-related information 58. For example, the power supply operation-related information 58 may include a configured operating range for the engine 26, an online/offline status of the hydraulic fracturing rig 14 or the engine 26, a power reserve of the hydraulic fracturing rig 14, an operating mode of the hydraulic fracturing rig 14 (e.g., a mode that prioritizes conserving fuel, a mode that prioritizes reducing fuel costs, and/or a mode that priorities reducing emissions), and/or the like. Additionally, or alternatively, the input data 56 may include cost-related information 60. For example, the cost-related information 60 may include a cost of fuel for the hydraulic fracturing rig 14, a total cost of ownership of the hydraulic fracturing rig 14 (e.g., including maintenance costs, costs of fracturing fluid, or personnel costs), a cost of emissions (e.g., regulatory costs applied to emissions or costs related to reducing emissions, such as DEF costs), and/or the like.

Additionally, or alternatively, the input data 56 may include power demand-related information 62. For example, the power demand-related information 62 may include a power demand for an experienced or expected load on the engine 26 (e.g., flow, proppant demand, or pressure response), a desired flow rate of fracturing fluid, a desired output pressure of the fracturing fluid, a desired gear ratio of the transmission 28, a desired transmission speed of the transmission 28, and/or the like. Additionally, or alternatively, the input data 56 may include operational priority and/or site configuration-related information 64. For example, the operational priority and/or site configuration-related information 64 may include a priority among multiple engines 26, an operating mode priority for operation of the hydraulic fracturing rig 14 (e.g., a prioritization of fuel cost reduction over emissions reduction, or vice versa), a quantity of hydraulic fracturing rigs 14 at a site, a maximum allowed pressure or flow rate of a hydraulic fracturing rig 14 at the site, quantities and/or types of other equipment located at the site, ages, makes, models, and/or configurations of the equipment at the site, and/or the like. The input data 56 may include various other types of data depending on the objective to be optimized by the optimization algorithm 66. For example, the input data 56 may include transmission gear life predictions, pump cavitation predictions, pump life predictions, engine life predictions, and/or the like.

As described in more detail below with respect to FIG. 4, the optimization algorithm 66 may process the input data 56 after receiving the input data 56. The optimization algorithm 66 may then output operational parameters 68 for available hydraulic fracturing rigs 14 (or other equipment of the hydraulic fracturing system 2) to the user device 24, to the controller 38 to control operations of the hydraulic fracturing rigs 14, and/or to the database 46. Operational parameters 68 may include, for example, values for engine power output, gear ratio, engine revolutions, throttle control, pump pressure, flow rate, or transmission speed.

INDUSTRIAL APPLICABILITY

The aspects of the site controller 50 of the present disclosure and, in particular, the methods executed by the site controller 50 may be used to optimize fuel costs and emissions of a hydraulic fracturing rig 14. Thus, certain aspects described herein may provide various advantages to the operation of the hydraulic fracturing rig 14, such as minimizing fuel costs while helping to ensure that emissions do not exceed associated thresholds and while maintaining a desired operating performance of the hydraulic fracturing rig 14. In addition, in optimizing fuel costs and emissions of the hydraulic fracturing rig 14, the site controller 50 may account for various types of fuels and/or emissions gasses and particulates, which helps improve the effectiveness of operational parameters determined through the optimization process.

Figure 4:
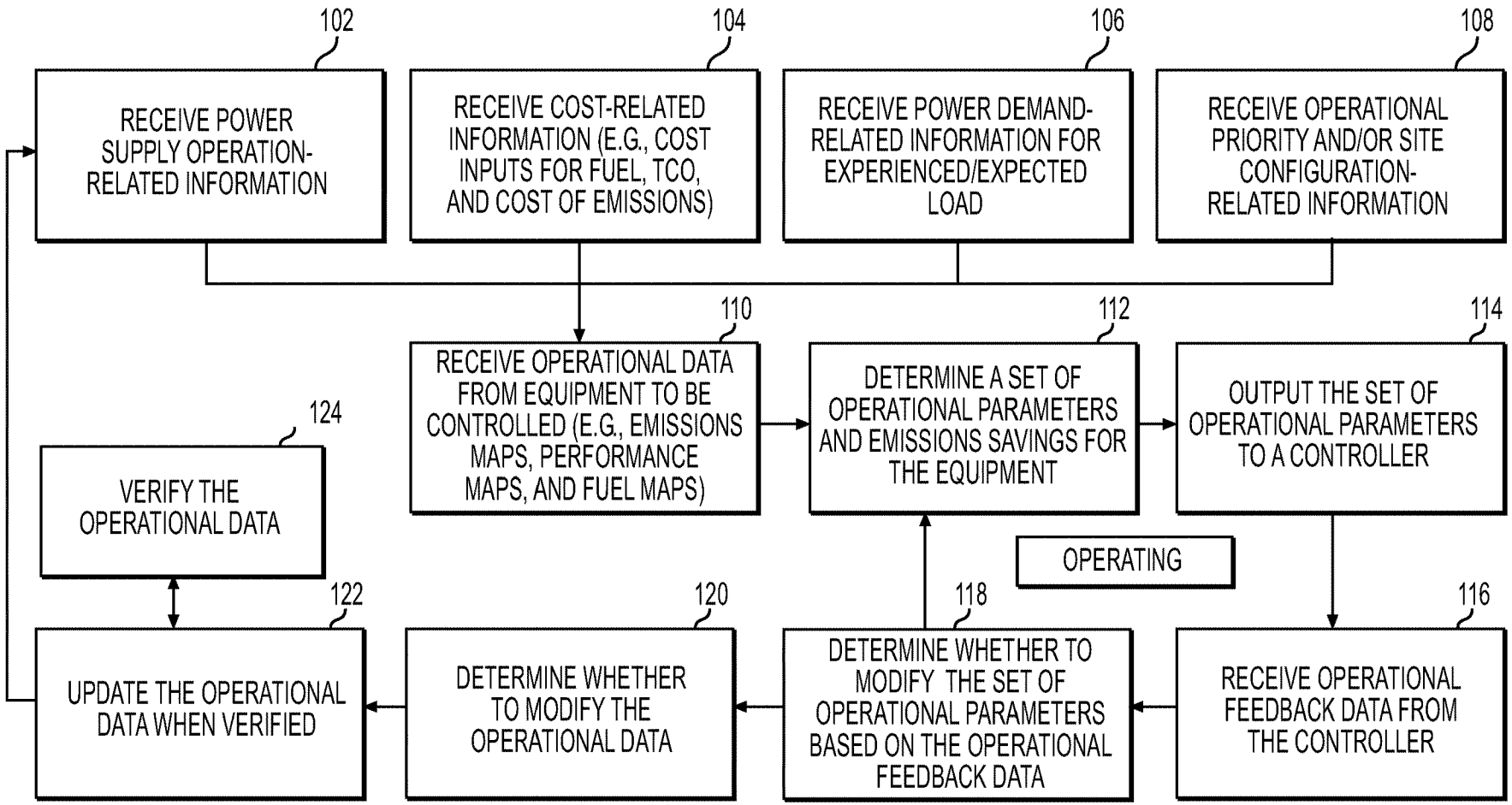
FIG. 4 illustrates a flowchart depicting an exemplary method for optimizing fuel consumption and emissions of a multi-rig hydraulic fracturing system.

FIG. 4 provides a flowchart depicting an exemplary method for optimizing fuel consumption and emissions of the multi-rig hydraulic fracturing system 2. The method illustrated in FIG. 4 may be implemented by the site controller 50. The steps of the method described herein may be embodied as machine readable and executable software instructions, software code, or executable computer programs stored in the memory 44 and executed by the processor 42 of the site controller 50. The software instructions may be further embodied in one or more routines, subroutines, or modules and may utilize various auxiliary libraries and input/output functions to communicate with other equipment. The method illustrated in FIG. 4 may also be associated with an operator interface (e.g., a human-machine interface, such as a graphical user interface (GUI)) through which an operator of the hydraulic fracturing rig 14 and/or the hydraulic fracturing system 2 may configure the optimization algorithm 66, may select the input data 56, may set objectives for the optimization algorithm 66, and/or the like. Therefore, the method may be implemented by the site controller 50 to minimize emissions while minimizing fuel costs, for example.

At step 102, the site controller 50 may receive power supply operation-related information (e.g., power supply operation-related information 58) and the site controller 50 may additionally receive cost-related information (e.g., cost-related information 58) at step 104. In step 106, the site controller 50 may receive power demand-related information for experienced/expected load (e.g., power demand-related information 62) and, in step 108, may receive operational priority and/or site configuration-related information (e.g., operational priority and/or site configuration-related information 64). The site controller 50 may receive the information at steps 102, 104, 106, and 108 as input via the user device 24, from the database 46, and/or the like.

At step 110, the site controller 50 may receive operational data from equipment to be controlled. For example, the site controller 50 may receive operational data for one or more hydraulic fracturing rigs 14 from the database 46 based on the data received at steps 102, 104, 106, and/or 108. The operational data may include emissions maps, performance maps, fuel maps, and/or the like associated with the hydraulic fracturing rig 14. A map according to the present disclosure may provide an indication of output parameters of a particular equipment or component thereof as a function of input parameters, such as operating conditions of the hydraulic fracturing rig 14 or a component of the hydraulic fracturing rig 14. For example, an emissions map may indicate an amount of emissions as a function of engine speed and percentage of peak torque or as a function of power output and engine revolution rate. As another example, a performance map may indicate engine efficiency as a function of engine power output and engine age or may indicate parasitic loss of the pump 30 as a function of flow rate and fluid output pressure. As yet another example, a fuel map (e.g., a brake specific fuel consumption (BSFC) map) may indicate a fuel efficiency of the engine 26 based on the rate of fuel consumption and the power produced by the engine 26.

The operational data may also include an SCR map for the SCR system. For example, the SCR map may indicate a conversion rate (or conversion efficiency) of, for example, nitrogen oxides in the engine exhaust emissions at different operating conditions of the engine 26 and at different SCR temperatures or different DEF injection rates. Additionally, or alternatively, the operational data may include an EGR map for the EGR system. For example, the EGR map may indicate an effectiveness (or efficiency) of re-combustion of exhaust gas at different operating conditions of the engine 26. Additionally, or alternatively, the operational data may include a lean burn map for the lean burn system. For example, the lean burn map may indicate a fuel consumption efficiency of the lean burn system at different operating conditions of the engine 26.

The site controller 50 may, in step 112, determine a set of operational parameters (e.g., operational parameters 68) and emissions savings for the equipment. For example, the site controller 50 may select values for various operational parameters 68 for a hydraulic fracturing rig 14 and may determine fuel consumption costs and emissions costs of the hydraulic fracturing rig 14 based on those values. In determining the values for the various operational parameters 68, the site controller 50, via the optimization algorithm 66, may optimize one or more objectives. For example, the objective may be of any suitable type, such as reducing the cost of the fracking operation, reducing emissions from the fracking operation, reducing idle time during the fracking operation, reducing wear on fracking equipment during the fracking operations, increasing efficiency of the fracking operation, reducing an overall time of the fracking operation, reducing the cost of ownership of the equipment used in the fracking operation, and/or any combinations thereof. As a specific example, the site controller 50 may determine operational parameters 68 that minimize fuel costs or emissions costs according to certain maximum limits on such costs. As another specific example, if multiple operating points for the hydraulic fracturing rigs 10 provide lower operating costs, the site controller 50, via the optimization algorithm 66, may select one of the points based on an objective, such as selecting the point with the lowest emissions output.

As indicated above, step 112 may include determining emissions savings. When determining the emissions savings, the site controller 50 may calculate an amount of emissions or emissions cost difference between two sets of operational parameters 68, such as a set input by an operator using the user device 24 and an optimized set of operational parameters 68 determined by the site controller 50. The site controller 50 may then determine this difference to be the emissions savings of the optimized operational parameters 68, and this information may be output via the user device 24 and/or stored in the database 46, for example.

The determining of the operational parameters 68 may include a determination of an apportionment of power demand to various hydraulic fracturing rigs 14 included in the hydraulic fracturing system 2. To allow for the engines 26 to be operated in a manner that optimizes the emissions produced by, and cost of fuel consumed by, multiple engines 26, the site controller 50 may be configured to perform an optimization process that determines an optimized apportionment of the power demand to the individual operating engines 26 based upon minimizing engine emissions constrained by fuel cost limits. To this end, the site controller 50 may apportion the power demand from the load manager 54 based on emission output information associated with each engine 26 based on an emission output map and a fuel consumption map included in the operational data received at 110. The maps may be different for each engine 26 and/or for each different type of engine 26, as needed. The site controller 50 may then compare different apportionments of the power demand from the load manager 54 with the emission output map and fuel consumption map to determine the particular configuration of apportionments that provides the overall lowest exhaust emission output possible from all of the engines 26 within fuel cost limitations. This may result in an equal or unequal apportionment of the power demand between the different engines 26, and some engines 26 may be turned off. In some implementations, similarly configured hydraulic fracturing rigs 14 or engines 26 may be apportioned a similar or different proportion of the power demand.

Whether the site controller 50 apportions the power demand based on total engine emissions and fuel costs may be determined by an operator of the hydraulic fracturing system 2 or it may be automatically determined based signals relating to other hydraulic fracturing system 2 functions. Accordingly, the site controller 50 may be configured to receive information indicative of selection of a mode (e.g., an emission mode and/or a fuel consumption mode), which may communicate to the site controller 50 whether to enable the engine emission control mode and/or the fuel consumption mode. The mode selection information may be input through the user device 24, for example in the data monitoring system 22, by an operator. Additionally, or alternatively, the mode selection information may also include information that may signal an automatic enablement of the apportionment of the power demand such as, for example, information relating to the location of the hydraulic fracturing system 2 (e.g., in an area with certain limitations on emissions) and/or information relating to an operating mode of the engines 26. Additionally, or alternatively, the mode selection information may include information regarding whether the hydraulic fracturing system 2 is in a condition in which enablement of a mode may not be appropriate or a condition in which the mode may be enabled (e.g., enablement of a fuel consumption mode or an emissions mode may not be appropriate unless hydraulic fracturing rigs 14 with a certain configuration are present at a site).

In determining the optimized apportionment of the power demand, the optimization process performed by the site controller 50 may also take into account one or more additional considerations that may constrain the minimization of exhaust emissions and/or fuel costs. For example, the site controller 50 may take into account engine operation information. The engine operation information considered by the site controller 50 may include information relating to any priorities assigned to the hydraulic fracturing rigs 14 or the engines 26. In such a case, the site controller 50 may be configured to apportion the power demand to the higher priority hydraulic fracturing rigs 14 or the engines 26 first. One example of an engine priority situation is where certain hydraulic fracturing rigs 14 of the hydraulic fracturing system 2 must be run together. The site controller 50 may also take into account other engine operation information, such as which hydraulic fracturing rigs 14 may be offline and the current operating status of the hydraulic fracturing rig 14. The engine operating information may also include a predefined or desired operating range for one or more of the hydraulic fracturing rigs 14. For example, the desired operating range for each of the various hydraulic fracturing rigs 14 in the hydraulic fracturing system 2 may be different. The engine operation information may also include a desired power reserve. Specifically, the operator of the hydraulic fracturing rig 14 or the hydraulic fracturing system 2 may desire a particular amount of power be left in reserve, and this power reserve may limit the way in which the site controller 50 can apportion the power demand.

After constraints are applied, the site controller 50 may then determine the optimized apportionment of the power request to each operating hydraulic fracturing rig 14 or engine 26 that minimizes the exhaust emissions output from the hydraulic fracturing rig 14 or the engine 26 within fuel consumption or cost constraints. In some embodiments, this determination may involve the use of a particle swarm optimization method. In determining the optimized apportionment, different weight factors may be applied to the total engine emissions and the total costs to reflect the relative importance of these considerations.

At step 114, the site controller 50 may output the set of operational parameters 68 to a controller (e.g., controller 38). For example, the site controller 50 may output the set of operational parameters 68 to the controller 38 so that the controller 38 can generate control signals to cause a hydraulic fracturing rig 14, an engine 26, a transmission 28, or any other component of the hydraulic fracturing rig 14 or any other equipment of the hydraulic fracturing system 2 to operate according to the set of operational parameters 68. The control signals may indicate any suitable operations, such as engine power output, revolutions, throttle control, transmission speed, gear ratio, flow rate, pressure, and/or the like. These control signals may be transmitted to various controllers 38 associated with the particular equipment or components to be controlled, and the controllers 38 may be configured to operate the equipment or components in accordance with the control signals.

Additionally, or alternatively, the site controller 50 may output the set of operational parameters 68 to the user device 24. For example, the site controller 50 may output the set of operational parameters 68 to the user device 24 prior to outputting the set of operational parameters 68 to the controller 38 (e.g., so that a user of the user device 24 can review, accept, decline, modify, etc. the set of operational parameters 68 prior to implementing the set of operational parameters 68).

The operations illustrated at steps 116 and 118 may be performed while the hydraulic fracturing rig 14 is operating. For instance, the site controller 50 may then receive operational feedback data from the controller 38 at step 116. For example, the sensors 34 may gather values for operational parameters 68 of the hydraulic fracturing rig 14 (e.g., of the engine 26, the transmission 28, or the hydraulic fracturing pump 30) and the sensors 34 may provide this data to the site controller 50. As specific examples, the feedback data may include whether the transmission 28 is operating in a desired gear, measured pressures at inlets or outlets of the hydraulic fracturing pump 30, measured emissions from the engine 26 during operation, measured fuel consumption of the hydraulic fracturing rigs 10 during operation, and/or the like. At step 118, the site controller 50 may determine whether to modify the set of operational parameters 68 based on the operational feedback data. For example, the site controller 50 may determine to modify the set of operational parameters 68 if the operational feedback data indicates that the values for the operational parameters 68 differ from the optimized values determined at step 112 (e.g., differ by an amount that exceeds a threshold or differ for an amount of time that exceeds a threshold). Additionally, or alternatively, the site controller 50 may determine whether predicted fuel costs or predicted emissions costs match actual fuel costs or emissions costs based on the operational feedback data, and may determine to modify the set of operational parameters 68 if the predicted costs do not match the actual costs. Determining to modify the set of operational parameters 68 may cause the method to return to step 112 where the site controller 50 may re-perform steps 112, 114, and 116 described above.

If the site controller 50 determines to not modify the set of operational parameters 68, then the site controller 50 may determine, at step 120, whether to modify the operational data received at step 110 above. At step 122, the site controller 50 may update the operational data when verified.

For example, the site controller 50 may receive new information at 102, 104, 106, and 108 and may receive new operational data at step 110. The site controller 50 may then proceed to perform the operations at steps 112, 114, 116, 118, 120, 122, and/or 122. At step 124, the site controller 50 may verify the operational data as part of updating the operational data at 122.

Although the method illustrated in FIG. 4 is described as including steps 102 to 124, the method may not include all of these steps or may include additional or different steps. For example, the method may just include receiving the information at steps 102, 104, 106, and 108, receiving the operational data at step 110, determining the set of operational parameters 68 at step 112, and outputting the set of operational parameters 68 at step 114.

The site controller 50 of the present disclosure can provide real-time (or near real-time) optimization of fuel consumption and emissions reduction, among other objectives, based on existing and planned operating conditions and limits, including fuel cost limits, of available assets. Thus, aspects of the present disclosure may output operating parameters which may help provide lower overall emissions while balancing the cost of fuel and helping to ensure sufficient operating performance of the hydraulic fracturing rig 14. This may improve operation of a hydraulic fracturing rig 14 without the hydraulic fracturing rig 14 experiencing a significant degradation in performance.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A hydraulic fracturing system, comprising:
- a plurality of hydraulic fracturing rigs comprising one or more fuel consumption components and one or more emissions components;
- one or more controllers configured to control operation of the plurality of hydraulic fracturing rigs; and
- a site controller in communication with the plurality of hydraulic fracturing rigs and the one or more controllers, the site controller being configured to:
  - receive operational data associated with the one or more fuel consumption components or the one or more emissions components,
  - determine a set of operational parameters based on the operational data and emissions output predictions for the plurality of hydraulic fracturing rigs,
  - output, to one or more computing devices or the one or more controllers, the set of operational parameters;
  - receive operational feedback data after outputting the set of operational parameters;
  - determine to modify the set of operational parameters based on the operational feedback data; and
  - modify the set of operational parameters based on determining to modify the set of operational parameters.

2. The hydraulic fracturing system of claim 1, wherein the operational data comprises:
- one or more emissions maps,
- one or more performance maps, or
- one or more fuel maps.

3. The hydraulic fracturing system of claim 1, wherein the site controller is further configured to:
- receive cost-related information comprising one or more of:
  - one or more costs of one or more fuels,
  - a total cost of ownership of the plurality of hydraulic fracturing rigs, or
  - one or more costs of emissions of the plurality of hydraulic fracturing rigs;
- determine emission savings of the plurality of hydraulic fracturing rigs based on the cost-related information; and
- output, to the one or more computing devices or the one or more controllers, information identifying the emission savings.

4. The hydraulic fracturing system of claim 1, wherein the operational feedback data is received from the one or more controllers after the set of operational parameters is outputted to the one or more controllers.

5. The hydraulic fracturing system of claim 1, wherein the site controller is further configured to:
- receive additional operational feedback data; and
- determine to not modify the set of operational parameters based on the additional operational feedback data.

6. The hydraulic fracturing system of claim 1, wherein the site controller is further configured to:
- determine to modify the operational data based on determining to not modify the set of operational parameters.

7. The hydraulic fracturing system of claim 1, wherein the site controller is further configured to:
- verify modifications to the operational data based on determining to modify the operational data; and
- update the operational data after verifying the operational data.

8. A method, comprising:
- receiving operational data associated with one or more fuel consumption components of a plurality of hydraulic fracturing rigs or one or more emissions components of the plurality of hydraulic fracturing rigs;
- determining a set of operational parameters based on the operational data and emissions output predictions for the plurality of hydraulic fracturing rigs;
- outputting the set of operational parameters to one or more computing devices or one or more controllers; and
- based on outputting the set of operational parameters to the one or more controllers:
  - receiving operational feedback data from the one or more controllers,
  - determining to not modify the set of operational parameters based on the operational feedback data,
  - determining to modify the operational data based on determining to not modify the set of operational parameters, and
  - modifying the operational data based on determining to modify the operational data.

9. The method of claim 8, wherein the one or more fuel consumption components or the one or more emissions components comprise:
- one or more variable frequency drives (VFD),
- one or more motors, or
- one or more pumps.

10. The method of claim 8, further comprising:
- re-receiving, after modifying the operational data, power supply-related information associated with the plurality of hydraulic fracturing rigs, cost-related information associated with the plurality of hydraulic fracturing rigs, power demand-related information associated with the plurality of hydraulic fracturing rigs, and operational priority or site configuration-related information associated with the plurality of hydraulic fracturing rigs.

11. The method of claim 10, wherein modifying of the operational data further comprises:

verifying modifications to the operational data based on determining to modify the operational data; and updating the operational data after verifying the operational data.

12. The method of claim 10, wherein the power supply-related information comprises one or more of:

a desired engine operating range for the plurality of hydraulic fracturing rigs, an engine online/offline status for the plurality of hydraulic fracturing rigs, or a desired power reserve for the plurality of hydraulic fracturing rigs.

13. The method of claim 10, wherein the power demand-related information comprises a power demand for an experienced or expected load on engines of the plurality of hydraulic fracturing rigs.

14. The method of claim 10, wherein the operational priority or site configuration-related information comprises:

an engine priority between the plurality of hydraulic fracturing rigs, an operating mode of the plurality of hydraulic fracturing rigs, a quantity of hydraulic fracturing rigs included in the plurality of hydraulic fracturing rigs, or a flow rate of the plurality of hydraulic fracturing rigs.

15. A site controller for a plurality of power sources comprising one or more fuel consumption components and one or more emissions components, the controller comprising:

a processor configured to:

receive operational data associated with the one or more fuel consumption components or the one or more emissions components, determine a set of operational parameters based on the operational data or emissions output predictions for the plurality of power sources;

output the set of operational parameters to one or more computing devices or one or more controllers;

receive operational feedback data after outputting the set of operational parameters;

determine to modify the set of operational parameters based on the operational feedback data; and modify the set of operational parameters based on determining to modify the set of operational parameters.

16. The site controller of claim 15, wherein the plurality of power sources include one or more mechanical hydraulic fracturing rigs or one or more electric hydraulic fracturing rigs, and wherein the one or more mechanical hydraulic fracturing rigs or the one or more electric hydraulic fracturing rigs provide flow, proppant demand, and pressure response associated with an experienced or expected load on an engine.

17. The site controller of claim 15, wherein the operational feedback data is received from the one or more controllers after the set of operational parameters is outputted to the one or more controllers.

18. The site controller of claim 15, wherein the processor is further configured to:

receive additional operational feedback data; and determine to not modify the set of operational parameters based on the additional operational feedback data.

19. The site controller of claim 18, wherein the processor is further configured to:

determine to modify the operational data based on determining to not modify the set of operational parameters.

20. The site controller of claim 19, wherein the processor is further configured to:

modify the operational data based on determining to modify the operational data, and re-receive, for the plurality of power sources and based on modifying the operational data, power supply-related information, cost-related information, power demand-related information, and operational priority or site configuration-related information.

* * * * *